US006832648B2

(12) United States Patent
Torigoe et al.

(10) Patent No.: US 6,832,648 B2
(45) Date of Patent: Dec. 21, 2004

(54) RESINOUS HEAT EXCHANGER AND A METHOD OF MANUFACTURING THE SAME

(75) Inventors: Eiichi Torigoe, Anjo (JP); Masahiro Shimoya, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/674,991

(22) Filed: Sep. 30, 2003

(65) Prior Publication Data

US 2004/0079521 A1 Apr. 29, 2004

(30) Foreign Application Priority Data

Oct. 2, 2002 (JP) ..... 2002-289794

(51) Int. Cl.[7] ..... F28D 1/00
(52) U.S. Cl. ..... 165/148; 165/153; 165/175
(58) Field of Search ..... 165/150–153, 165/148, 172–177; 29/890.03

(56) References Cited

U.S. PATENT DOCUMENTS 3,757,859 A * 9/1973 Hammon et al. ..... 166/173
3,845,814 A * 11/1974 Kun ..... 165/148
4,119,144 A * 10/1978 Kun ..... 165/175
4,874,035 A * 10/1989 Kashiwada et al. ..... 165/282
4,893,669 A * 1/1990 Kashiwada et al. ..... 165/282
4,955,435 A 9/1990 Shuster et al.
6,401,804 B1 6/2002 Shimoya et al.
2002/0005279 A1 * 1/2002 Maute ..... 165/148
2002/0144808 A1 * 10/2002 Jones ..... 165/173

FOREIGN PATENT DOCUMENTS

JP 55-35812 * 3/1980 ..... 165/173
JP 58-22896 * 2/1983 ..... 165/175

* cited by examiner

*Primary Examiner*—Terrell Mckinnon
(74) *Attorney, Agent, or Firm*—Harness, Dickey & Pierce, PLC

(57) ABSTRACT

In a resinous heat exchanger, a core portion includes a plurality of heat exchanging plate portions forming inside fluid passages therein and holding portions. The heat exchanging plate portions are layered with predetermined spaces between them so that outside fluid passages are formed between the adjacent heat exchanging plate portions. The heat exchanging plate portions are held by holding portions. The heat exchanging plate portions and the holding portions are integrally formed by extrusion of a resin material. Thus, the heat exchanger is light in weight and is capable of improving productivity.

10 Claims, 3 Drawing Sheets

RESINOUS HEAT EXCHANGER AND A METHOD OF MANUFACTURING THE SAME

CROSS REFERENCE TO RELATED APPLICATION

This application is based on Japanese Patent Application No. 2002-289794 filed on Oct. 2, 2002, the disclosure of which is incorporated herein by reference.

FIELD OF THE INVENTION

The present invention relates to a resinous heat exchanger constructed of a plurality of plate members defining inside fluid passages therein and a method of manufacturing the same. The heat exchanger is for example suitable in use as an evaporator for a vehicle air conditioner.

BACKGROUND OF THE INVENTION

JP-A-2001-41678 (U.S. Pat. No. 6,401,804 B1) discloses a heat exchanger constructed of a plurality of flat tubes without interposing fins between them. Each of the flat tubes is formed by joining a pair of aluminum plates such that inside fluid passages are formed therein. The flat tubes are layered such that outside fluid passages are formed between the adjacent tubes. Thus, the heat exchanger performs heat exchange between an inside fluid, such as refrigerant, flowing inside the flat tubes and an outside fluid, such as air, passing through the outside fluid passages. Since the heat exchanger is constructed of the layered aluminum plates, it is generally heavy in weight.

JP-B2-2749586 (U.S. Pat. No. 4,955,435)discloses a panel heat exchanger without having fins. A panel is formed by opposing two resinous sheets and bonding the two resinous sheets at necessary positions, so that header portions and fluid passages are formed in the panel. Since the heat exchanger is made of the resin material, it is generally light in weight. However, the panel requires a large heat exchanging surface area for maintaining efficiency of heat exchange. Therefore, it is likely to be difficult to maintain spaces for outside fluid passages when in use.

SUMMARY OF THE INVENTION

The present invention is made in view of the foregoing matter and it is an object of the present invention to provide a heat exchanger, which is made of resin and capable of improving productivity.

It is another abject of the present invention to provide a method of manufacturing a resinous heat exchanger, which is simple and capable of improving productivity.

According to the present invention, a heat exchanger includes a core portion made of resin and tank portions connected to ends of the core portions. The core portion includes a plurality of heat exchanging plate portions each forming inside fluid passages therein and a holding portion. The heat exchanging plate portions are layered with predetermined spaces between them and held by the holding portion. The heat exchanging plate portions and the holding portion are integrally formed into a single piece.

Accordingly, since the core portion is made of resin, it is light in weight. Also, it improves productivity. Preferably, the core portion is formed by removing predetermined portions from a resinous extrusion body. Accordingly, the core portion is easily produced, thereby improving the productivity of the heat exchanger.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

Figure 2:
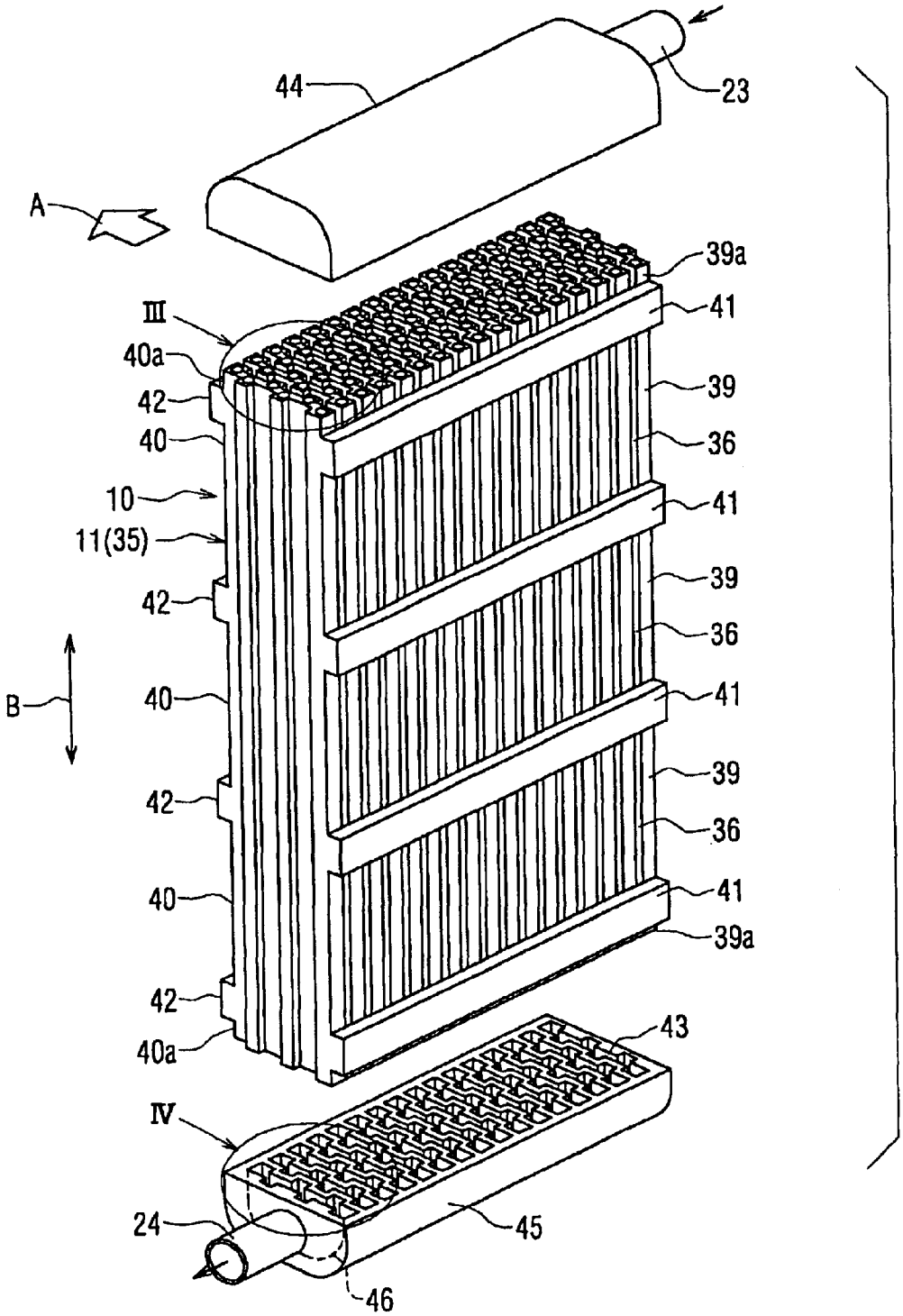
FIG. 2 is an exploded perspective view of a heat exchanger according to the embodiment of the present invention.

A heat exchanger 10 of the present invention is for example used for an evaporator of a vehicle air conditioner. As shown in FIG. 2, the evaporator 10 has a core portion 11 for performing heat exchange between an inside fluid such as a refrigerant and an outside fluid such conditioning air. The core portion 11 includes a plurality of heat exchanging plate portions 12 each forming inside fluid passages (refrigerant passages) 19 therein through which the inside fluid flows. The heat exchanging plate portions 12 are layered with predetermined spaces between them so that outside fluid passages are formed between the adjacent heat exchanging plate portions 12. Here, a flow direction A of the outside fluid is substantially perpendicular to a flow direction B of the inside fluid.

Figure 1:
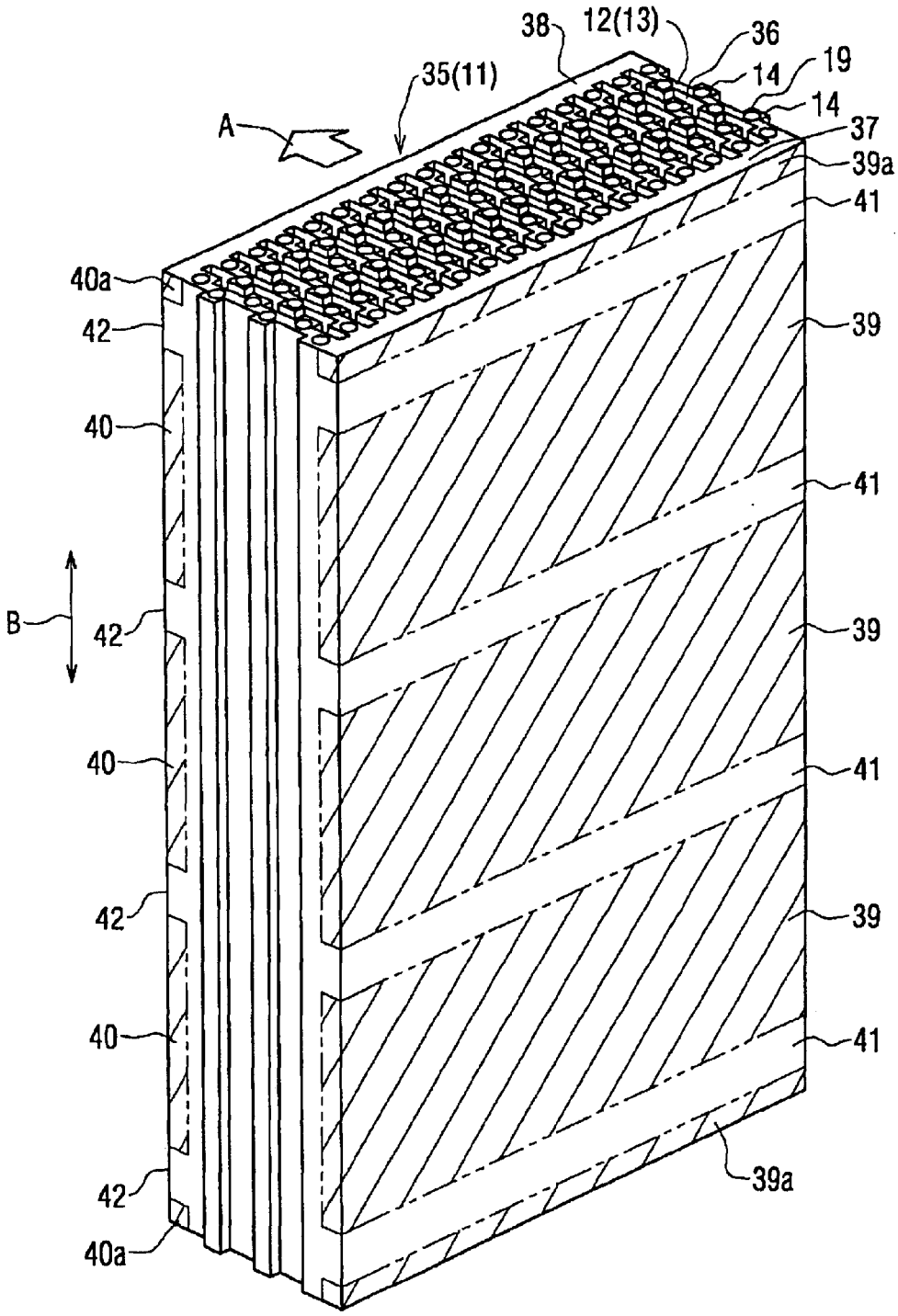
FIG. 1 is a perspective view of an extrusion body according to the embodiment of the present invention.

The layered heat exchanging plate portions 12 are integrally provided by extrusion of a resin material such as nylon. FIG. 1 shows an extrusion body 35 having substantially a rectangular parallelepiped shape right after the extrusion of the resin material. The extrusion body 35 forms peripheral end portions (end walls) 37, 38 opposing each other and the plurality of heat exchanging plate portions 12 between the peripheral end portions 37, 38. The heat exchanging plate portions 12 and the peripheral end portions 37, 38 are substantially perpendicular. Further, the heat exchanging plates 12 forms projection ribs 14 protruding from sides of the heat exchanging plates 12 in a direction that the plates 12 are layered. The projection ribs 14 have substantially trapezoidal-shaped cross-sections or substantially rectangular-shaped cross-sections. Furthermore, the refrigerant passages (inside fluid passages) 19, which have substantially circular-shaped cross-sections are formed in the heat exchanging plates 12. Spaces 36 for constructing air passages (outside fluid passages) are formed between the heat exchanging plates 12.

Right after the extrusion, the spaces 36 are closed at ends in the air flow direction A by the peripheral end portions 37, 38, as shown in FIG. 2. In this condition, the spaces 36 do not function as the air passages. Then, the peripheral end portions 37, 38, which are located on the ends of the spaces 36, are partly removed so that the ends of the spaces 36 are open in the air flow direction A. Specifically, portions 39, 39*a*, 40, 40*a*, which correspond to shaded portions in FIG. 1, are removed by such as cutting.

FIG. 2 shows the extrusion body 35 after the portions 39, 39*a*, 40, 40*a* are removed. The ends of the spaces 36 are open in the air flow direction A. The portions 39, 39*a*, 40, 40*a* are divided in a longitudinal direction of the rectangular parallelepiped shape, and portions 41, 42 are not removed from the extrusion 35. Therefore, the heat exchanging plates 12 are integrally held by the portions (holding portions) 41, 42. For example, the portions 41, 42 are narrow and extend perpendicular to the longitudinal directions of the heat exchanging plates 12.

Figure 4:
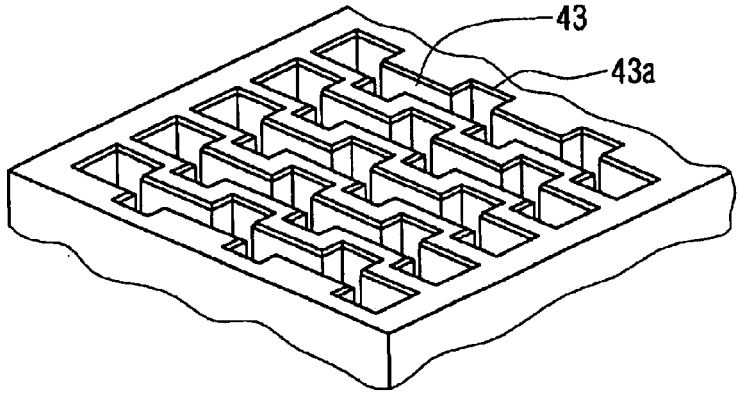
FIG. 4 is a partly enlarged perspective view of a tank portion of the heat exchanger denoted by a circle IV in FIG. 2.

As shown in FIG. 2, tank portions 44, 45 are connected to the longitudinal ends of the extrusion body 35 (core portion 11) from which the portions 39*a*, 40*a* are removed. As shown in FIGS. 2 and 4, the tank portions 44, 45 are formed with slits 43 into which the longitudinal ends of the heat exchanging plates 12 are inserted. The tank portions 44, 45 forms communication passages 46 in the insides so that the slits 43 are communicated through the communication passages 46 in the inside of the tank portions 44, 45. Further, as shown in FIG. 4, the tank portions 44, 45 have slanting surfaces(chamfer surfaces) 43*a* at the end of the slits 43 into which the ends of the heat exchanging plates 12 are inserted. The slanting surfaces 43*a* incline with respect to the longitudinal directions of the heat exchanging plates 12.

The tank portions 44, 45 are formed by injection molding of a resin material such as nylon. The tank portions 44, 45 has connecting portions 23, 24 into which refrigerant pipes (not shown) are connected, respectively. The connecting portions 23, 24 have substantially pipe shape, for example. The refrigerant flows in and out the tank portions 44, 45 through the connecting portions 23, 24. In an example shown in FIG. 2, the connecting portion 23 of the upper tank 44 forms a refrigerant inlet and the connecting portion 24 of the lower tank 44 forms a refrigerant outlet.

The refrigerant flowing into the upper tank 44 from the refrigerant inlet 23 is divided into the refrigerant passages 19 formed in the heat exchanging plates 12. After passing through the refrigerant passages 19, the refrigerant collects in the lower tank 45 and flows out from the refrigerant outlet 24. In assembling the evaporator 10 the core portions 11 and the tank portions 44, 45 are bonded by using an adhesive agent such as epoxy resin.

For example, the refrigerant inlet 23 communicates with a pressure reducing device such as an expansion valve of a refrigerant cycle through the refrigerant pipe. The refrigerant outlet 24 communicates with an inlet of a compressor (not shown) through the refrigerant pipe. Thus, the gas and liquid refrigerant decompressed in the pressure reducing device is introduced into the evaporator 10. After the refrigerant is evaporated in the evaporator 10, the refrigerant in a phase of gas is introduced to the compressor.

Figure 3:
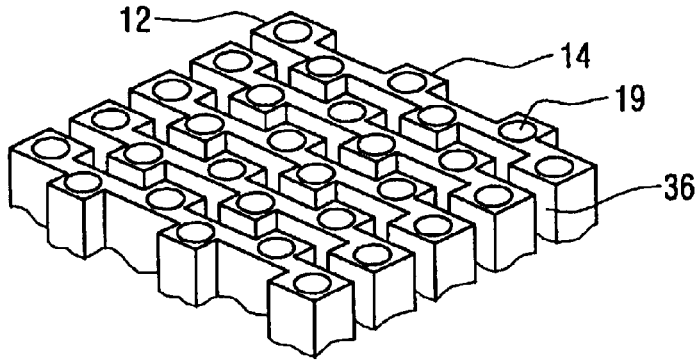
FIG. 3 is a partly enlarged perspective view of an end of a core portion of the heat exchanger denoted by a circle II in FIG. 2.
Figure 5:
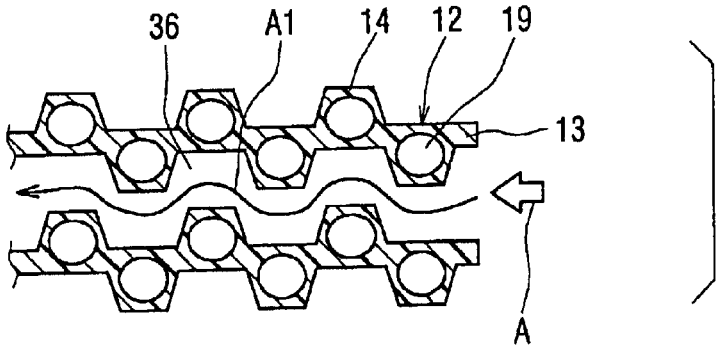
FIG. 5 is a schematic cross-sectional view of heat exchanging plates of the heat exchanger for showing air passages formed between the heat exchanging plates according to the embodiment of the present invention.

As shown in FIG. 5, each of the heat exchanging plates 12 has projection ribs 14 that protrude from both surfaces of a base plate portion 13, which is substantially in a form of substantially plate. The projection ribs 14 have substantially trapezoidal-shaped cross-sections or rectangular-shaped cross-sections, as shown in FIGS. 3 and 5. The projection ribs 14 form the refrigerant passages 19 that have substantially circular-shaped cross-sections therein. The projection ribs 14 continuously extend in the longitudinal direction of the heat exchanging plates 12, that is, substantially perpendicular to the air flow direction A. The longitudinal axes of the refrigerant passages 19 are parallel to each other. For example, each of the heat exchanging plates 12 has six projection ribs 14 and six refrigerant passages 19 therein, as shown in FIG. 3. Minimum thickness of the wall defining the refrigerant passage 19 is approximately between 0.1 mm and 0.4 mm.

The projection ribs 14 project from the base plate portion 13 alternately in opposite directions. Thus, the projection ribs 14 of one heat exchanging plate 12 and the projection ribs 14 of the adjacent heat exchanging plate 12 project to the space 36 alternately with respect to the air flow direction A. More specifically, the projection ribs 14 of one heat exchanging plate 12 oppose to recessions between the projection ribs 14 of the adjacent heat exchanging plate 12.

Further, the adjacent heat exchanging plates 12 are spaced from each other by a predetermined distance such that predetermined clearance is defined between the end surfaces of the projection ribs 14 and the opposing surface of the base plate portion 13 of the adjacent heat exchanging plate 12. Thus, continuous air passage 36 is formed in form of wave between the adjacent heat exchanging plates 12 as denoted by a waved arrow Al in FIG. 5. Accordingly, the conditioning air supplied to the core portion 11 in the direction A passes between the heat exchanging plates 12 while meandering as in form of wave as shown by the arrow A1.

The evaporator 10 is housed in an air conditioning unit case (not shown) for example in up and down direction shown in FIG. 2. The conditioning air is supplied to the evaporator 10 by a blower unit in the direction shown by the arrow A. When the compressor is driven, the gas and liquid refrigerant, which is decompressed by the pressure reducing device, is supplied into the evaporator 10.

In the core portion 11, the air passes through the air passages 36 formed between the heat exchanging plates 12. While the conditioning air passes through the air passages 36, the refrigerant flowing in the refrigerant passages 19 absorbs heat from the conditioning air. Therefore, the conditioning air is cooled.

The air flow direction A is perpendicular to the longitudinal direction B of the projection ribs 14. The projection ribs 14 have surfaces (heat exchanging surfaces) that are substantially perpendicular to the air flow direction A. Thus, the straight flow of the air is blocked by the surfaces of the projection ribs 14.

Because the flow of the air is disturbed between the heat exchanging plates 12, the disturbed air flow improves efficiency of the heat exchange of the air flow. Here, since the core portion 11 is only constructed of the heat exchanging plates 12, that is, the core portions 11 does not have fins, the heat exchanging area of the core portion 11 is smaller than that of a heat exchanger having fins between heat exchanging plates. The decrease of the heat exchanging area is compensated by the improvement of the heat exchanging efficiency of the disturbed air flow. Accordingly, heat exchanging capacity is maintained.

Next, effects of the embodiment will be described. First, the core portion 11 is constructed of the layered heat exchanging plates 12 defining the refrigerant passages 19 therein. The air passages 36 are formed between the adjacent heat exchanging plates 12. Further, the heat exchanging plates 12 are spaced from each other by predetermined distance and held by the holding portions 41, 42. The heat exchanging plates 12 and the holding portions 41, 42 are integrally formed into a single article. Accordingly, the evaporator 10 is reduced in weight. Further, productivity of the evaporator 10 improves.

The core portion 11 is integrally formed by extrusion of the resin material. After the extrusion, the peripheral end portions 37, 38 are partly removed by such as cutting and the holding portions 41, 42 are remained without removing. Since the core portion 11 are formed by removing necessary portions from the extrusion body 35, it is simply and easily produced. Thus, this improves productivity of the evaporator 10.

The projection ribs 14 protrude from the base plate portions 13 and forming the circular shaped refrigerant passages 19 therein. Further, the projection ribs 14 have substantially trapezoidal-shaped cross-sections or rectangular-shaped cross-sections. The heat exchanging plates 12 having this configuration are integrally formed by extrusion of the resin material. Further, the shape the projection ribs 14 increases the heat exchanging surface area. Also, the refrigerant passages 19 are formed to have substantially circular-shaped cross-sections for maintaining pressure withstanding. Accordingly, the heat exchanging plates 12 are formed with the suitable shapes.

The tank portions 44, 45 are formed by molding of the resin material. The tank portions 44, 45 includes the refrigerant inlet portion 23, the refrigerant outlet portion 24, the communication passages and the slits 43 for receiving the longitudinal ends of the heat exchanging plates 12. By this configuration, the weight of the evaporator 10 is reduced. Also, this improves productivity of the evaporator 10. Further, since the evaporator 10 is only formed of the resin material, it is easily recycled after the use.

Further, the slits 43 have slanting surfaces 43*a* at the ends through which the longitudinal ends of the heat exchanging plates 12 are inserted. Therefore, the core portion 11 is easily fitted into the tank portions 44, 45. Further, the core portion 11 and the tank portions 44, 45 are bonded by the adhesive agent. Because the step of heating such as for brazing is not required, it is easily assembled by a simple assembly, thereby reducing power for the assembly.

In the above embodiment, the heat exchanger 10 made of the resin material is used for the evaporator for performing heat exchange between the low-pressure side refrigerant of the refrigerant cycle and the conditioning air. However,the heat exchanger of the present invention can be used for another heat exchanger that performs heat exchange between fluids for other purposes.

In the above embodiment, the air flow direction A is perpendicular to the longitudinal directions B of the refrigerant passages 19. However, it is possible to incline the air flow direction A at a predetermined angle from the longitudinal directions B of the refrigerant passages 19 as long as the air flow direction A intersects the longitudinal directions B of the refrigerant passages 19.

The present invention should not be limited to the disclosed embodiments, but may be implemented in other ways without departing from the spirit of the invention.

What is claimed is:

1. A heat exchanger comprising:

a core portion for performing heat exchange between an inside fluid and an outside fluid; and tank portions connected to ends of the core portion, wherein the core portion is made of resin and includes a plurality of heat exchanging plate portions, each of which forms inside fluid passages therein through which the inside fluid flows, and a holding portion, and the plurality of heat exchanging plate portions are layered with predetermined spaces therebetween and held by the holding portion, the heat exchanging plate portions and the holding portion are integrally formed; and the core portion is provided by a resinous extrusion.

2. The heat exchanger according to claim 1, wherein each of the heat exchanging plate portions includes a base portion substantially in a form of plate and projection ribs projecting from the base portion, wherein each of the projection ribs has one of a substantially trapezoidal-shaped cross-section and a substantially rectangular-shaped cross-section and forms the inside fluid passage therein.

3. The heat exchanger according to claim 2, wherein the inside fluid passage has substantially a circular-shaped cross-section.

4. The heat exchanger according to claim 2, wherein the projection ribs project from the base portion alternately in opposite directions, thereby forming waved outside fluid passages through which the outside fluid flows between the adjacent heat exchanging plates.

5. The heat exchanger according to claim 1, wherein the tank portions are made of resin, wherein each of the tank portions forms slits in which ends of the heat exchanging plate portions are received and a communication passage for allowing the slits to communicate in the tank portion.

6. The heat exchanger according to claim 5, wherein the tank portions form communication ports through which the inside fluid is introduced into and discharged from the communication passages of the tank portions.

7. The heat exchanger according to claim 5, wherein the tank portions have slanting surfaces at ends of the slits through which the ends of the heat exchanging plate portions are inserted.

8. The heat exchanger according to claim 1, wherein the core portion and the tank portions are bonded.

9. The heat exchanger according to claim 1, wherein the holding portion extends substantially perpendicular to longitudinal directions of the heat exchanging plate portions for holding the layered heat exchanging plate portions.

10. A method of manufacturing the heat exchanger of claim 1 comprising:

forming an extrusion body by extrusion of a resin material so that the extrusion body has end walls opposing each other and a plurality of heat exchanging plate portions perpendicular to the end walls between the end walls and the plurality of heat exchanging plate portions are layered with predetermined spaces therebetween; and removing predetermined portions of the end walls so that the spaces defined between the adjacent heat exchanging plate portions are open in directions parallel to the heat exchanging plate portion and the heat exchanging plate portions are held by remaining portions of the end walls.

* * * * *